US005863050A

United States Patent [19]

Meader et al.

[11] Patent Number: 5,863,050

[45] Date of Patent: Jan. 26, 1999

[54] SNOWBOARD INSERT PLATE

[75] Inventors: Allen L. Meader, Port Orchard; Louis J. Fezio, Vashon, both of Wash.

[73] Assignee: K-2 Corporation, Vashon, Wash.

[21] Appl. No.: 573,017

[22] Filed: Dec. 15, 1995

[51] Int. Cl.[6] ..... A63C 5/075

[52] U.S. Cl. ..... 280/14.2; 280/610

[58] Field of Search ..... 280/14.2, 601, 280/607, 610; 411/84, 85, 101; 441/70

[56] References Cited

U.S. PATENT DOCUMENTS

| | | | |
|---|---|---|---|
| 2,384,729 | 9/1945 | Darby | 411/84 |
| 2,395,650 | 2/1946 | Allen | 411/84 |
| 2,526,137 | 10/1950 | Hunt . | |
| 3,722,901 | 3/1973 | Koike . | |
| 3,917,299 | 11/1975 | Anderson | 280/11.13 W |
| 4,349,212 | 9/1982 | Svoboda . | |
| 5,016,901 | 5/1991 | Mayr . | |
| 5,197,752 | 3/1993 | Engelbert et al. . | |
| 5,221,105 | 6/1993 | Mayr et al. . | |
| 5,320,378 | 6/1994 | Wiig . | |
| 5,401,041 | 3/1995 | Jespersen . | |
| 5,419,665 | 5/1995 | Adams et al. | 411/84 |

FOREIGN PATENT DOCUMENTS

| | | | |
|---|---|---|---|
| 214326 | 2/1960 | Australia . | |
| 0 474 967 A1 | 3/1992 | European Pat. Off. . | |
| 0 496 352 A1 | 7/1992 | European Pat. Off. . | |
| 1282053 | 12/1961 | France . | |
| 2 431 868 | 2/1980 | France . | |
| 620028A1 | 10/1994 | France | 280/607 |
| 1 923 367 | 11/1970 | Germany . | |
| 29 13 250 | 10/1980 | Germany . | |
| WO 91/12056 | 2/1991 | WIPO . | |
| WO 92/22361 | 12/1992 | WIPO . | |

*Primary Examiner*—Peter C. English
*Assistant Examiner*—Avraham H. Lerner
*Attorney, Agent, or Firm*—Christensen O'Connor Johnson & Kindness PLLC

[57] ABSTRACT

A method of constructing a ski, snowboard, or the like having a base, a core, and a top is disclosed. The method includes the steps of providing an insert plate, placing the insert plate between the base and the top, substantially surrounding the insert plate with the core, and joining the base and the top to the core. Bindings may be secured to the insert plate by fastening them to the insert plate. The insert plate includes a substantially flat portion and a plurality of threaded inserts extending upwardly to the insert plate. The inserts are integrally formed with the flat portion by being stamped from a metal plate that forms the flat portion. Apertures are also formed in the metal plate such that frame arms extend between the individual inserts to support the inserts and hold them with respect to one another. The insert plate is placed between the base and the top in a position relative to the base and the top for optimum securing bindings to the insert plate. The finished snowboard made according to the method is also disclosed.

48 Claims, 5 Drawing Sheets

SNOWBOARD INSERT PLATE

FIELD OF THE INVENTION

The present invention relates to runners such as skis, snowboards, or the like for gliding or sliding on a surface, and more particularly to a fastening element with the body of a runner for binding attachment to the runner.

BACKGROUND OF THE INVENTION

A skier or snowboarder exerts significant stresses on bindings. With snowboarding, for example, the binding must remain firmly secured to the board while the rider sets an edge, turns, jumps, lands, and so forth. Even under extreme stress a serious safety issue would arise should the binding be released from the board. In such an instance only one leg would be attached to the board with resultant excessive leverage to twist and injure an ankle or leg. The attachment structure for receiving fasteners within a snowboard must also be accurately placed since bindings include predefined spacing between fasteners. Furthermore, the attachment structure must not move or twist under stress when in a snowboard during snowboarding or attachment of the bindings.

Most present manufacturers employ threaded inserts within snowboards for binding attachment. The inserts are cylindrical with a threaded bore opening at the top and a flange at the bottom. The purpose of the flange is to stop the insert from being pulled from the board under the stresses placed on it by the binding. However the flange is small and round. Thus, the insert may still be torn from the board in some instances.

Furthermore, when the bindings are being installed a machine screw is tightly screwed into the inserts. The twisting forces of the screw may cause the insert to rotate within the board, especially if there are placement errors or imperfections on insert or screw threads that introduce additional resistance to turning the screw.

Accurate and precise placement of the inserts within the board may be challenging during snowboard manufacturing since each insert must be individually located correctly with respect to both the board and the other inserts. Inaccurate placement of the inserts will shift the required place of binding mounting to a non-optimum location or orientation. Imprecise placement will make securing binding fasteners within the inserts difficult since interference will result as the distances between the fasteners in some directions are predefined.

If the snowboard is to be constructed with an injection molded core, the placement issues discussed above may be compounded. The individual inserts must be placed between the top and bottom of the board before the foam is injected into the board. Nevertheless, the inserts must not move during all the assembling and injection steps.

Therefore, a method and apparatus for providing a secure, safe, and easily manufacturable binding attachment structure within a snowboard, ski, or the like is not provided by the prior art. The present invention addresses these issues to overcome the limitations currently encountered.

SUMMARY OF THE INVENTION

The present invention includes a method of constructing a ski, snowboard, or the like that has a base, a core, and a top. The method includes providing an insert plate, placing the insert plate between the base and the top, substantially surrounding the insert plate with a core, and joining the base and the top to the core. The insert plate is provided within the ski, snowboard, or the like for securing bindings thereto. The insert plate includes a substantially flat portion and a plurality of threaded inserts extending outwardly therefrom. The inserts are fixedly joined to the flat portion. The insert plate is placed between the base and the top in a position relative to the base and the top for securing the bindings.

Preferably, the insert plate is constructed from a single piece of material. The inserts are integrally formed within the piece of material. The material is preferably a metal plate with the inserts being stamped into the plate. After the inserts are stamped therein such that they project outwardly from the metal plate, internal threads are cut into the inserts for receiving fasteners. The plate includes apertures therein such that a metal framework remains around the apertures for supporting and interconnecting the plurality of inserts. The inserts project upwardly from a flat portion of the metal plate. The flat portion is preferably positioned adjacent the top of the base.

In one of the preferred methods of the invention the core comprises a foam core. The step of surrounding the insert plate with the core comprises injecting the foam between the base and the top after the insert plate is placed there between. The foam fills the space between the base and the top and surrounds the insert plate. After the foam is injected between the top and the base, and around the insert plate, holes are formed within the top directly above the inserts for allowing fasteners to extend through the top into the inserts.

In the preferred embodiment of the invention, the base and top include structural reinforcement material within outer layers. The core is inserted between the structural reinforcement material of the top and base.

In an alternate preferred embodiment of the method of the invention, the core is constructed of wood. The method further includes cutting a recess in the core that matches the shape of the insert plate. This allows mating engagement of the wood core with the insert plate.

Additional interconnected inserts may alternatively be placed adjacent the plurality of interconnected inserts within the core between the base and the top. This additional method step provides additional places for binding fasteners to be secured.

The invention also includes an apparatus, such as a ski, snowboard, or the like, for gliding over a surface. The apparatus includes a base, a top, a core, a plurality of inserts, and a frame. The base provides the bottom running surface of the apparatus. The top is positioned above the base. The core is positioned between the base and the top. The plurality of inserts are positioned between the base and the top as well. The inserts have openings therein for receiving fasteners to secure a binding. The frame interconnects the inserts to fixedly position each of the inserts with respect to each other.

Preferably, the inserts and the frame are integrally joined together. The inserts and the frame are made up of a sheet of metal with the inserts projecting outwardly from a substantially flat portion of the sheet. The inserts include internal threads for receiving fasteners. The frame includes frame members with openings in the sheet between frame members. The frame members interconnect the inserts so that they are not allowed to be torn from the apparatus or twist therein.

In one embodiment of the invention, the core is constructed of foam. The foam core substantially surrounds the sides of the inserts, and at least one side of the frame.

In another embodiment the core is constructed of wood. The core includes a recess therein for matingly receiving the inserts and frame.

In the preferred embodiments of the invention the flat portion of the sheet is disposed adjacent the base. The inserts project upwardly from the flat portion through the core.

The method and construction of the present invention provide several advantages over the prior art methods of constructing snowboards with inserts. The interconnection of multiple inserts with a framework, such that the inserts are fixed relative to one another, provides for increased accuracy in placement of the inserts within the snowboard. The interconnecting framework also provides a substantial anchor to all of the inserts such that they cannot be torn from the snowboard. The fact that the inserts are formed or fixedly connected to the framework or insert plate does not allow any of the individual inserts to be twisted or rotated within the snowboard when a fastener is being secured thereto. The apertures between the frame members reduce the amount of material that is used for an insert plate and thus provide a lightweight insert plate. These advantages combine to allow the manufacture of a snowboard or other ski device at a lower cost and higher quality, while improving the safety of the board and decreasing the chance of error, both in the manufacturing of the board and in attaching bindings to a board.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

The apparatus and method of the present invention are useful on any device to which a user's feet are to be secured to an elongated member for gliding over a surface. The device and method of the present invention find particularly advantageous use with snowboards. The invention provides an improved connection of the snowboard bindings to the snowboard. However, the same concepts described herein for use with snowboards can be applied to skis and other runners.

Figure 1:
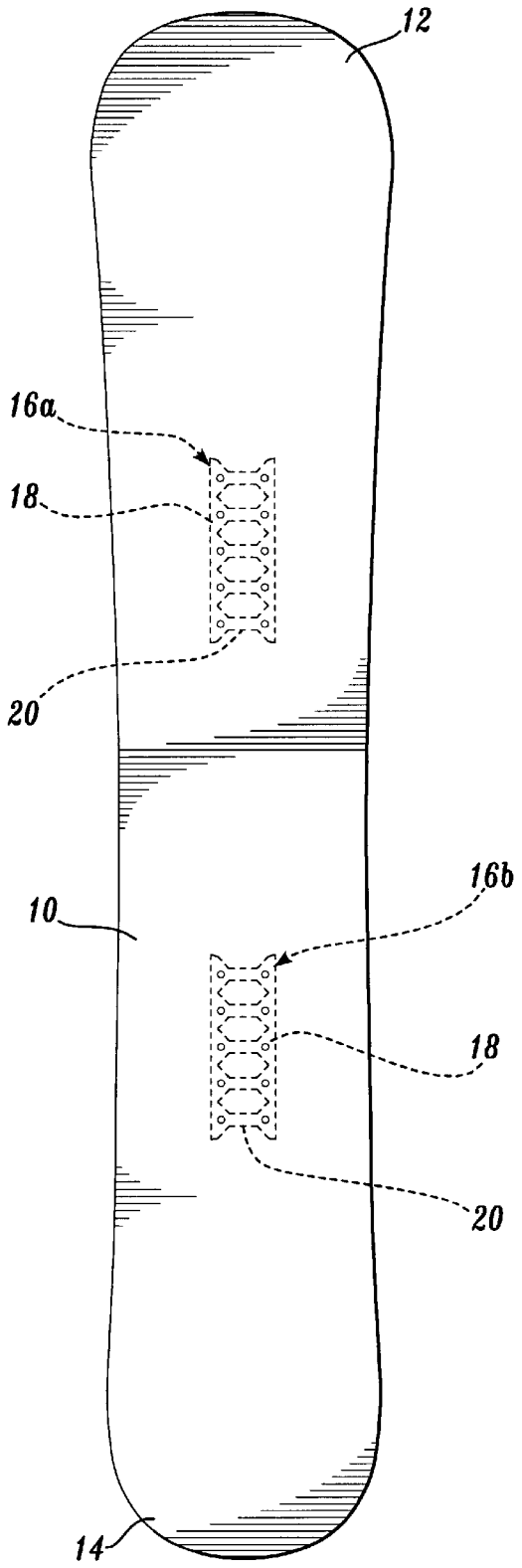
FIG. 1 is an elevational view of a snowboard with insert plates shown with hidden lines in their preferred positions within the board.

FIG. 1 is an elevational view of a snowboard 10. Snowboard 10 includes a tip 12 and a tail 14 on opposite ends of the board. A forward insert plate 16A and a rearward insert plate 16B are secured within the board in positions under which snowboard bindings are to be secured to the board.

Note that throughout this detailed description reference numbers combined with letters indicate like components or similar components for all referenced items that include the same number while possibly having a different letter. Thus, if "insert plate" is referred to simply as insert plate 16, it may be considered as either forward insert plate 16A or rearward insert plate 16B, or both.

Insert plates 16 include inserts 18 projecting upwardly therefrom and being accessible from the top of the snowboard. Inserts 18 are interconnected by a frame 20. Frame 20 provides support to inserts 18 and interconnects inserts 18 such that they are fixed with respect to each other and such that they are anchored so as not to rotate when a binding fastener is secured within inserts 18.

Figure 2:
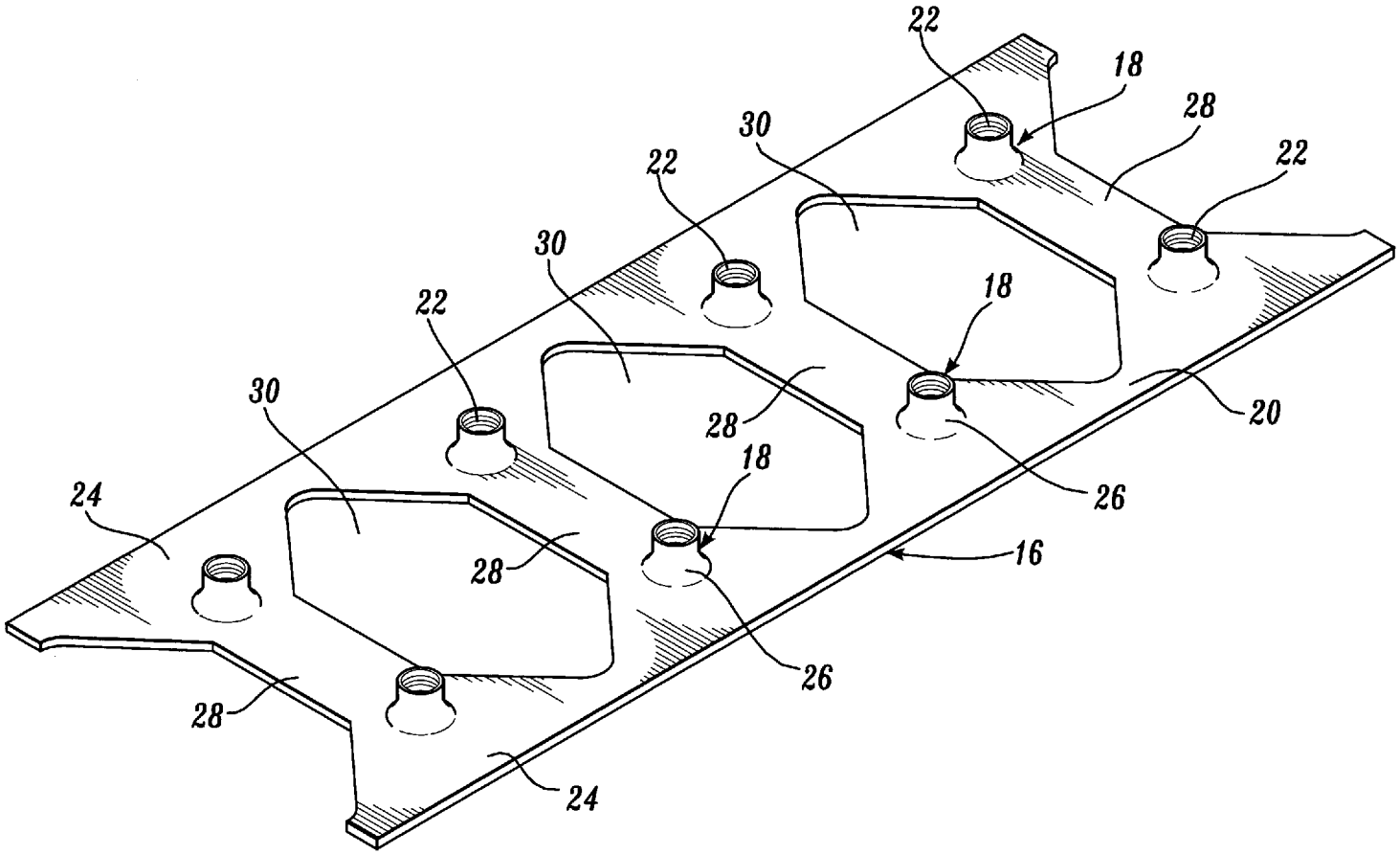
FIG. 2 is a perspective view of a snowboard insert plate of the present invention.

FIG. 2 provides more detail as to the specific construction of insert plate 16. Inserts 18 are cylindrical in shape with their axis being normal to insert plate 16 and frame 20. Thus, inserts 18 also extend generally perpendicular to snowboard 10 when placed therein. Inserts 18 include threaded bores 22 for receiving snowboard binding fasteners. Insert plate 16 may include two or more inserts projecting upwardly therefrom. Preferably, eight inserts are provided projecting from insert plate 16. Alternatively, inserts 18 could project downwardly from frame 20 of insert plate 16.

Inserts 18 are integrally formed with frame 20, both preferably from a sheet of stainless steel. Frame 20 includes triangular anchors 24 surrounding the base of inserts 18. Triangular anchors 24 are significantly larger than the diameter of inserts 18. The surface area of triangular anchors 24 prohibits inserts 18 from being pulled from snowboard 10. Triangular anchors 24 are connected at their corners, one to another, to preferably provide two rows of inserts with four inserts 18 in each row. Fillets 26 make the transition from triangular anchors 24 to inserts 18. Inserts 18 are preferably stamped within insert plate 16 such that fillets 26 are formed during stamping.

Insert plate 16 may alternatively be constructed from a material other than stainless steel. Another metal may be used or a composite material, for example. In one preferred alternate embodiment, insert plate 16 is constructed from fiberglass reinforced plastic, preferably urethane. In this embodiment, an insert plate mold is preferably used, such that the reinforced urethane (or other plastic such as nylon) is injected into the mold. The entire shape, including threads is preferably molded in this manner, such that the insert plate 16 would be ready for placement in the snowboard upon removal from the insert plate mold.

This embodiment of the method provides an insert plate that is less expensive to manufacture, lighter in weight, and at least equally as strong. Since the threads are molded in no cutting is required. The uncut glass reinforcement produces strong threads. The other advantage to a molded insert plate 16 is that inserts 18 are preferably molded with closed bottoms. Thus, a machine screw for binding attachment cannot be accidentally inserted so far as to break through the bottom of snowboard 10. Furthermore, the closed bottom prohibits moisture from being channeled into the board.

The two rows of triangular anchors 24 and inserts 18 are preferably interconnected by interconnection members 28. Interconnection members 28 are also part of the same sheet of material that formed insert plate 16. Each of interconnection members 28 extend between two inserts 18. Thus, a generally ladder shaped insert plate 16 is provided with the rungs of the ladder corresponding to interconnection members 28 and the ladder rails corresponding to triangular anchors 24 connected, one to another, at their bases.

Apertures 30 are formed between interconnection members 28 and triangular anchors 24. Thus, in the preferred embodiment, apertures 30 are hexagonal in shape. By providing insert plate 16 with apertures 30, insert plate 16 is lighter in weight than if this material was not removed to form apertures 30. Thus, frame 20 results with inserts 18 extending upwardly therefrom and being supported by frame 20 to resist both rotation and translation with respect to one another and with respect to snowboard 10. Since inserts 18 are simply stamped within insert plate 16, the manufacturing costs are low. Also, the accuracy of the placement of inserts 18 is assured by this method.

The overall configuration of insert plate 16 is generally rectangular. Alternatively, however, the plate may be round, oval, or any other shape as long as it provides support for at least two inserts used for securing a binding to a snowboard. Furthermore, apertures 30, anchors 24, and members 28 may have different configurations from those illustrated and described. Apertures 30 may be nonexistent in an alternate embodiment.

Figure 3:
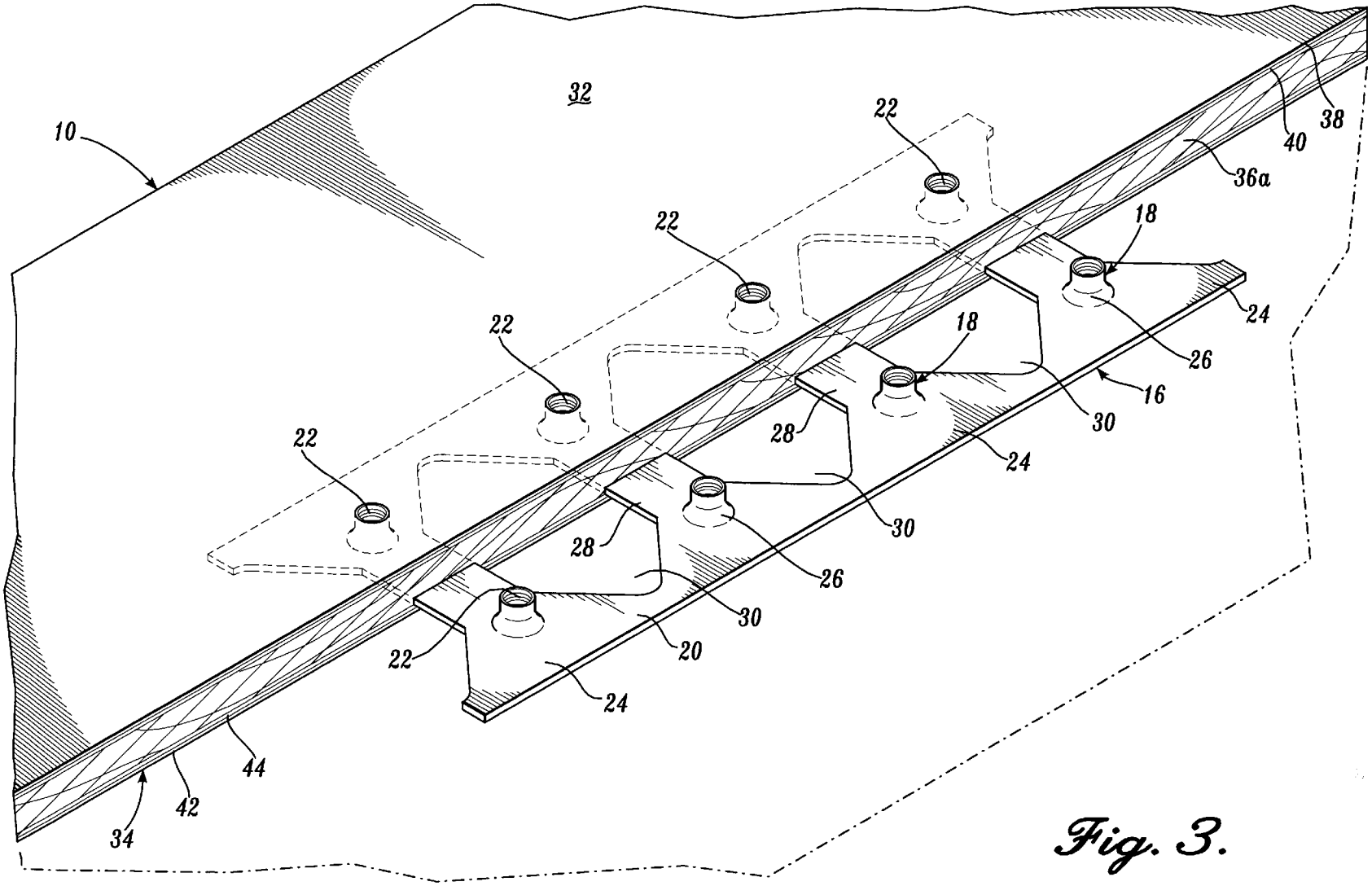
FIG. 3 is a view of a snowboard insert plate within a recess cut within a wood core of a snowboard.

FIG. 3 illustrates the placement of insert plate 16 within snowboard 10. In this preferred embodiment of the invention, snowboard 10 includes a top 32, a base 34, and a wood core 36*a*. Top 32 is constructed of a top laminate 38 and a top reinforcement layer 40 joined beneath top laminate 38. Top laminate 38 is preferably a polyurethane. Top reinforcement layer 40 is preferably fiberglass. Base 34 is made up of a base laminate 42 and a base reinforcement layer 44. Base laminate 42 may be a urethane or a polyethylene. Other materials may alternatively be used. Wood core 36*a* is joined between top 32 and base 34. Other constructions, such as torsion box instead of laminate construction, may also be used with top 32, base 34 and core 36.

In the preferred embodiment of the invention, insert plate 16 is disposed on top of base reinforcement layer 44. A recess is cut within wood core 36*a* for receiving insert plate 16, including frame 20 and inserts 18. Thus, insert plate 16 is placed within the cut recess of wood core 36*a* and joined between the recess of wood core 36*a* and base reinforcement layer 44. Inserts 18 extend upwardly into wood core 36*a,* preferably to the top of wood core 36*a*. Access holes 52 are cut within top 32, including top laminate 38 and top reinforcement layer 40, to provide access to threaded bores 22 of inserts 18.

Wood core 36*a* is provided with the recess, preferably by using a milling machine, which precisely cuts wood core 36*a* into a recessed shape to matingly engage insert plate 16 and securely hold it therein in a precise position.

Figure 4:
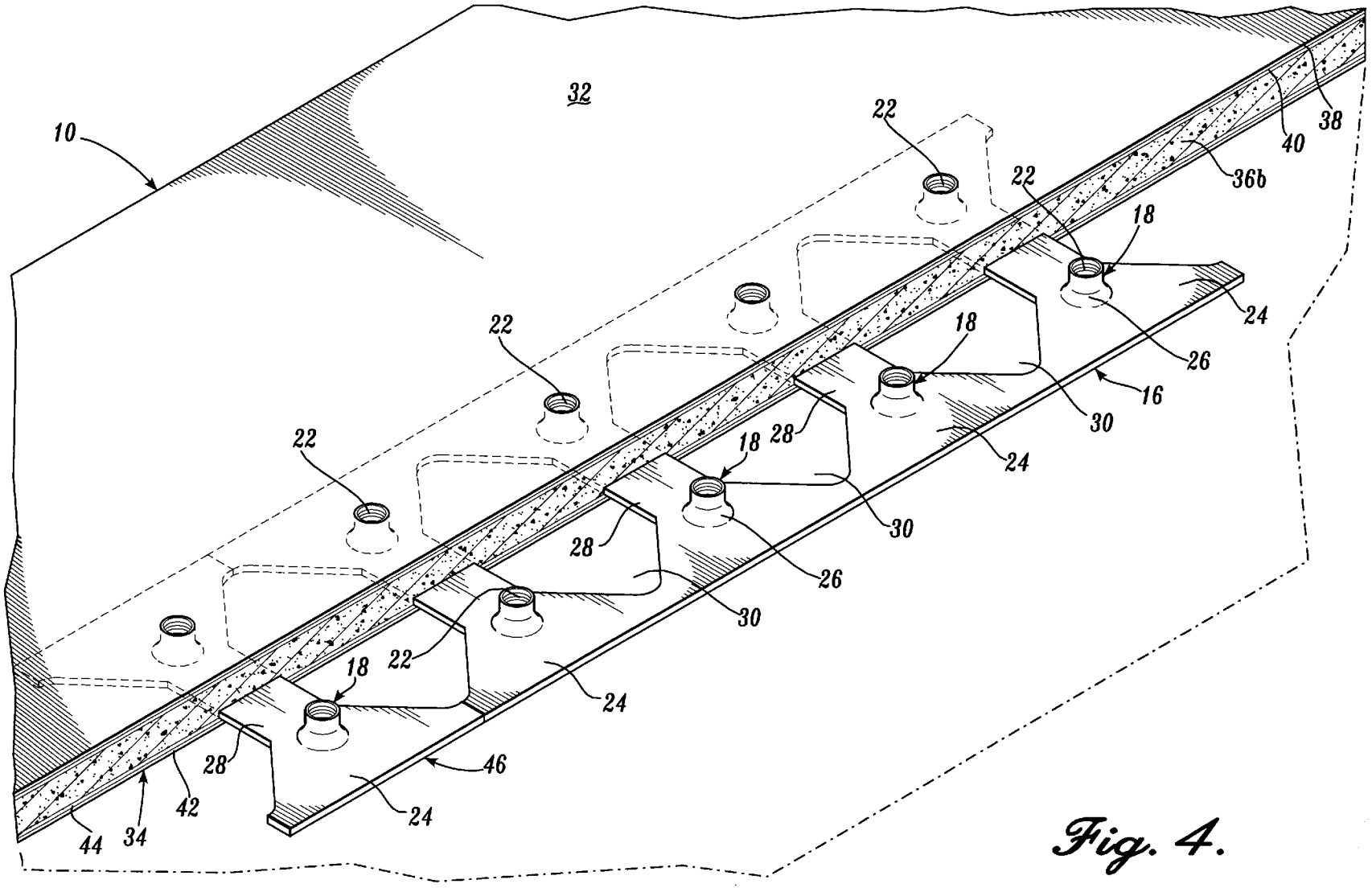
FIG. 4 is a perspective view of a portion of a cutaway snowboard showing the insert plate within the core between the top and base of the snowboard.

Snowboard 10 may alternatively be constructed with a foam core or other core materials. FIG. 4 illustrates snowboard 10 constructed with a foam core 36*b*. Other details of snowboard 10 in FIG. 4 are essentially the same as those illustrated in FIG. 3 and as discussed above. When used with a foam core, core 36*b* may be cut to provide a recess, as was done with wood core 36*a,* or foam core 36*b* may be injection molded between top 32 and base 34 after insert plate 16 has been placed between top 32 and base 34, as shown in FIG. 5.

FIG. 4 also illustrates the use of insert plate 16 in a modular fashion with additional inserts 18 provided on a separate two-bore insert plate 46. Two-bore insert plate 46 is substantially the same as insert plate 16 except that it only includes two inserts. Two-bore insert plate 46 abuts the end triangular anchors 24 of insert plate 16 so as to provide a longer effective insert plate that includes two additional inserts 18 to provide ten inserts total. Two-bore insert plate 46 may alternatively be a four-bore insert plate or other numbers of inserts. Furthermore, insert plate 16 may include other number of inserts 18. Thus, standard or more common sizes of insert plates with common numbers of inserts 18 may be constructed and then abutted with additional insert plates 46 for alternative constructions with different numbers of inserts. This modular construction method maintains the low cost of the operation while still providing accurate placement and a secure hold on binding fasteners. Two-bore insert plate 46 is placed between top 32 and base 34 with insert plate 16 before foam core 36*b* is injected therebetween.

Figure 5:
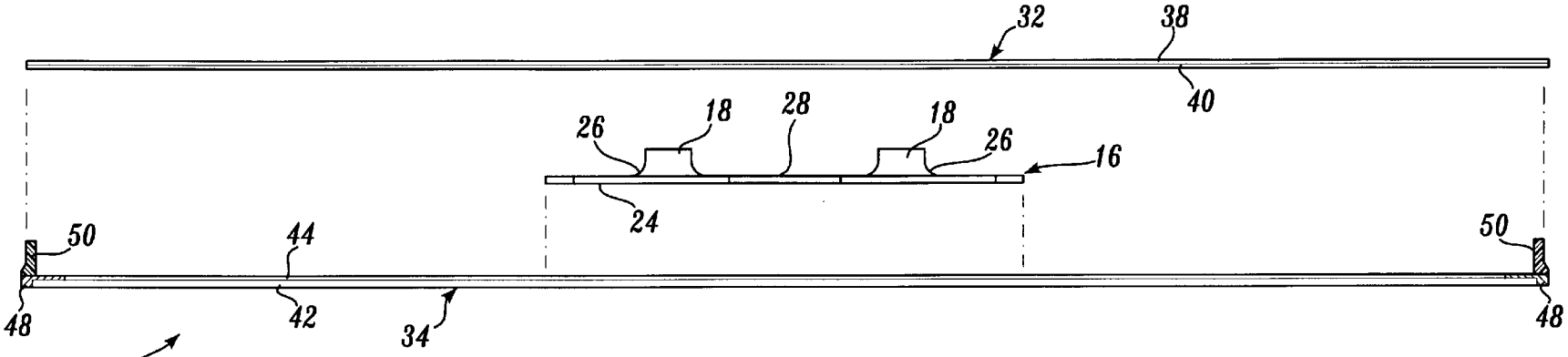
FIG. 5 illustrates the method of forming a foam core snowboard with an insert plate therein.
Figure 6:
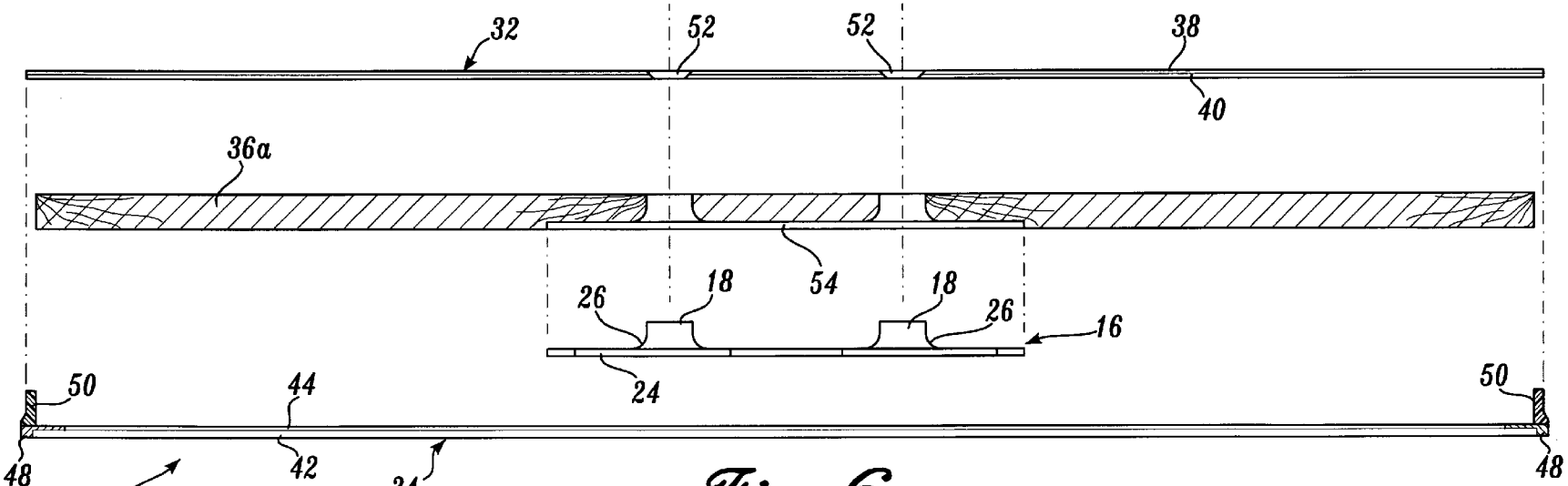
FIG. 6 illustrates the method of assembling a wood core snowboard with an insert plate placed therein.

FIGS. 5 and 6 illustrate the method of constructing a snowboard with insert plate 16 in a foam core snowboard and, in FIG. 6, in a wood core snowboard. These cross-sectional views also illustrate the placement of steel edges 48 at the sides of base 34. Steel edges 48 are preferably the standard edges used in the industry.

Side walls 50 are also shown. Side walls 50 are preferably constructed of ABS and extend from base 34 on top of steel edges 48 to top 32 such that a complete enclosure of core 36 is made. Alternatively, a cap-type top construction could be used in which top 32 extends not only over the top of core 36, but down the sides to meet with base 34 and steel edges 48.

If a torsion box construction is used, it may completely surround core 36 including insert plate 16. Alternatively, insert plate 16 may be placed externally over a torsion box reinforcement layer and still extend therethrough and into and through core 36.

The method of constructing a foam core snowboard preferably includes the steps of joining the base reinforcement layer 44 to base laminate 42 and steel edges 48 to make the subassembly base 34. The subassembly top 32 is also separately constructed with top laminate 38 joined to the top reinforcement layer 40. Top 32, base 34 and side walls 50 are then placed within a mold with insert plate 16 precisely positioned on base reinforcement layer 44 beneath top 32. Insert plate 16 may be glued into place or otherwise attached in the proper location between top 32 and base 34. This attachment need only be temporary so as to withstand the next step of injecting foam between top 32 and base 34 to create foam core 36*b*. Foam core 36*b* then substantially envelopes insert plate 16 around the sides of inserts 18 and the top and sides of frame 20. The bottom of frame 20 remains against base 34, while the tops of inserts 18 remain against the bottom of top reinforcement layer 40.

Alternatively, insert plate 16 may have frame 20 positioned adjacent top reinforcement layer 40 with inserts 18 projecting downwardly therefrom. In either case, foam core 36*b* securely holds insert plate 16 in place once cured. Access holes 52 are then drilled within top 32 to provide access to threaded bores 22 of insert plate 16.

The method of construction with a wood core provides a similar end product, except that wood is being used instead of foam. However, the method is different since the wood core is obviously not injected into the snowboard. Instead, an insert plate recess 54 is milled into the bottom of wood core 36*a* to matingly engage insert plate 16. Access holes 52 may be drilled within top 32 prior to assembly or after assembly. The entire structure may be assembled while top reinforcement layer 40 and base reinforcement layer 44 are still wet, such that once cured, they bind the assembly together into a single unit comprising snowboard 10. If a torsion box construction is used, insert plate 16 may be placed within insert plate recess 54 of wood core 36*a* prior to being wrapped with the torsion box, and the torsion box core insert plate assembly being placed between base 34, top 32 and side walls 50. Access holes 52 would then also extend through the portions of the torsion box directly above inserts 18 to provide access to threaded bores 22.

The methods of the present invention, as described above, alleviate the problems of the prior art in precise placement of the individual inserts, as well as the inserts turning within the snowboard when fasteners are secured therein. Since the bases of inserts 18 are integrally formed or securely affixed to frame 20, they are not allowed to turn or move relative to the other inserts 18. The assembly process is quicker and thus more efficient. Insert plate 16 is also cost effective to construct from a sheet of stainless steel. Inserts 18 are stamped into the plate and then threaded. As mentioned above, the surface area of frame 20 will not allow any of the individual inserts to be pulled from snowboard 10, even with extreme upward pressure from the binding fasteners.

While the preferred embodiments of the invention has been illustrated and described, it will be appreciated that various changes can be made therein without departing from the spirit and scope of the invention.

The embodiments of the invention in which an exclusive property or privilege is claimed are defined as follows:

1. A method of constructing a snow runner having a base, a core, and a top, the method comprising:

(a) providing an insert plate to which bindings may be secured, the insert plate including a substantially flat portion and a plurality of threaded inserts extending outwardly therefrom, the inserts being fixedly joined to the flat portion;

(b) placing the insert plate between the base and the top in a position relative to the base and top for securing bindings;

(c) after placing the insert plate between the base and the top, substantially layering the insert plate with the core, wherein said flat portion of said insert plate from which the threaded inserts extend is layered below at least a portion of the core; and (d) joining the base and the top to the core.

2. The method of claim 1, wherein the insert plate is constructed from a single piece of material, the inserts being integrally formed therein.

3. The method of claim 2, wherein the insert plate is constructed of a metal plate, the inserts being stamped into the metal plate after which internal threads are cut into the inserts.

4. The method of claim 3, wherein the insert plate includes apertures therein, a metal framework remaining around the apertures for supporting and interconnecting the plurality of inserts.

5. The method of claim 2, further including forming the insert plate of a plastic composite material, the inserts being integrally formed therewith.

6. The method of claim 5, wherein the insert plate is injection molded, and wherein internal threads are molded into the inserts during injection molding.

7. The method of claim 6, wherein the insert plate is molded with glass reinforced urethane.

8. The method of claim 1, wherein the insert plate is a framework of material interconnecting the plurality of inserts.

9. The method of claim 1, wherein the inserts project upwardly from the flat portion, the flat portion being positioned substantially flat on the base.

10. The method of claim 9, wherein the core comprises a foam core, and wherein layering the insert plate with the core comprises injecting the foam between the base and the top after the insert plate is placed therebetween, the foam filling space between the base and the top and surrounding the insert plate.

11. The method of claim 1, wherein the core comprises a foam core, and wherein layering the insert plate with the core comprises injecting the foam between the base and the top, after the insert plate is placed therebetween, the foam filling space between the base and the top and surrounding the insert plate.

12. The method of claim 11, further comprising forming holes within the top directly above the inserts for allowing fasteners to extend through the top into the inserts.

13. The method of claim 1, wherein the base and the top include structural reinforcement material within outer layers, the core being inserted between the structural reinforcement material of the top and base.

14. The method of claim 1, wherein the core comprises wood, the method further comprising cutting a recess in the core matching the shape of the insert plate for mating engagement therewith when the insert plate is layered with the core.

15. The method of claim 1, further comprising abutting a second insert plate to the first insert plate in a modular fashion to provide the snow runner with a longer effective insert plate and additional inserts.

16. A method of constructing a snow runner having a base, a core, and a top, the method comprising:

(a) providing a plurality of interconnected inserts to which bindings may be secured, the inserts being connected by a frame of material, the inserts including openings therein in a substantially normal direction from the frame; and (b) layering the inserts at least substantially with the core after placing the inserts between the base and the top, wherein said flat portion of said insert plate from which the threaded inserts extend is layered below at least a portion of the core.

17. The method of claim 16, wherein the inserts are formed from a sheet of metal, the inserts being stamped into the metal sheet, the sheet providing the frame to fix the inserts with respect to each other.

18. The method of claim 16, wherein the inserts project upwardly from the interconnecting frame, the frame being placed adjacent the base.

19. The method of claim 17, wherein apertures are formed in the sheet of material between the inserts.

20. The method of claim 17, wherein the core is constructed of foam, the core being injected between the top and the base after the inserts have been layered therebetween, the core substantially surrounding the inserts and interconnecting frame.

21. The method of claim 17, wherein the core is constructed of wood, the method further comprising forming a recess within the wood core matching the shape of the inserts and interconnecting frame for layering inserts and interconnecting frame therein.

22. The method of claim 16, wherein the core is constructed of foam, the core being injected between the top and the base, after the inserts have been layered therebetween, the core substantially surrounding the inserts and interconnecting frame.

23. The method of claim 16, wherein the core is constructed of wood, the method further comprising forming a recess within the wood core matching the shape of the inserts and interconnecting frame for layering the inserts and interconnecting frame therein.

24. The method of claim 16, further comprising forming holes within the top directly above the inserts for attaching a binding thereto.

25. The method of claim 16, further comprising placing additional interconnected inserts adjacent the plurality of interconnected inserts within the core, between the base and the top, to form additional places for binding fasteners to be secured.

26. The method of claim 16, further including forming the inserts and the frame by injection molding an insert plate comprising the frame and the inserts integrally formed, the plate being formed of a plastic composite material.

27. The method of claim 26, wherein the core is constructed of foam, the core being injected between the top and the base after the insert plate has been layered therebetween, the core substantially surrounding the inserts and interconnecting frame.

28. The method of claim 26, wherein the core is constructed of wood, the method further comprising forming a recess within the wood core matching the shape of the insert plate for layering the insert plate therein.

29. The method of claim 16, wherein the frame of material comprises a substantially flat plate portion, the plurality of inserts extending outwardly therefrom.

30. An apparatus having a bearing member for gliding over a surface, the apparatus comprising:

(a) a base providing a bottom running surface;

(b) a top positioned above said base;

(c) a core positioned between said base and said top;

(d) a plurality of inserts layered beneath the core and positioned between the base and the top, said inserts having openings therein for receiving fasteners to secure a binding; and (e) a frame interconnecting said inserts, said frame and interconnected inserts being layered beneath at least a portion of the core, said frame fixedly positioning each of said inserts with respect to each other.

31. The apparatus of claim 30, wherein said inserts and said frame are integrally joined together, said inserts and said frame comprising a sheet of metal with said inserts projecting outwardly from a substantially flat portion of said sheet.

32. The apparatus of claim 31, wherein said inserts include internal threads for receiving fasteners.

33. The apparatus of claim 31, wherein said frame includes frame members with openings therein between frame members, said frame members interconnecting said inserts.

34. The apparatus of claim 33, wherein said core comprises foam, said core substantially surrounding the sides of said inserts and at least one side of the frame.

35. The apparatus of claim 33, wherein said core comprises wood, said core having a recess therein for matingly receiving said inserts and frame.

36. The apparatus of claim 31, wherein said flat portion of said sheet is disposed adjacent said base, said inserts projecting upwardly therefrom through said core.

37. The apparatus of claim 30, wherein the inserts and the frame are integrally formed by injection molding to define an insert plate with the inserts projecting upwardly from the frame.

38. The apparatus of claim 37, wherein the inserts include internal threads molded within the opening of the inserts during injection molding.

39. The apparatus of claim 38, wherein the insert plate is molded from a glass reinforced plastic.

40. An apparatus having a bearing member for gliding over a surface, the apparatus comprising:

(a) a base providing a bottom running surface;

(b) a top positioned above said base;

(c) a core positioned between said base and said top;

(d) a plurality of inserts layered with the core and positioned between the base and the top, said inserts having openings therein for receiving fasteners to secure a binding; and (e) a frame interconnecting said inserts, said frame and interconnected inserts being layered beneath at least a portion of the core, said frame fixedly positioning each of said inserts with respect to each other.

41. The apparatus of claim 40, wherein the frame includes an anchor surrounding the base of each insert, the anchors are larger than the openings of the inserts by a predetermined amount to prohibit the inserts from being pulled from the bearing member.

42. The apparatus of claim 41, wherein the anchors are triangular in shape and include corners, the corners of each anchor are connected to the corners of other anchors to provide at least two rows of inserts with at least two inserts in each row.

43. The apparatus of claim 41, wherein the inserts and the frame are integrally formed by injection molding to define an insert plate with the inserts projecting upwardly from the frame.

44. The apparatus of claim 43, wherein the inserts include internal threads molded within the opening of the inserts during injection molding.

45. The apparatus of claim 44, wherein the insert plate is molded from a glass reinforced plastic.

46. The apparatus of claim 43, further comprising a second insert plate abutted adjacent to the first insert plate in a modular fashion to provide the bearing member with a longer effective insert plate and additional inserts.

47. A method of constructing a snow runner having a base, a core, and a top, the method comprising:

(a) providing a first insert plate to which bindings may be secured, the first insert plate including a substantially flat portion and a plurality of threaded inserts extending outwardly therefrom, the inserts being fixedly joined to the flat portion;

(b) placing the first insert plate between the base and the top in a position relative to the base and top for securing bindings;

(c) abutting a second insert plate to the first insert plate in a modular fashion to provide the snow runner with a longer effective insert plate and additional inserts;

(d) after placing the first and second insert plates between the base and the top, substantially layering the insert plates with the core; and (e) joining the base and the top to the core.

48. An apparatus having a bearing member for gliding over a surface, the apparatus comprising:

(a) a base providing a bottom running surface;

(b) a top positioned above said base;

(c) a core positioned between said base and said top;

(d) a plurality of inserts layered with the core and positioned between the base and the top, said inserts having openings therein for receiving fasteners to secure a binding;

(e) a frame interconnecting said inserts, said frame fixedly positioning each of said inserts with respect to each other, wherein the frame includes an anchor surrounding the base of each insert, the anchors being larger than the openings of the inserts by a predetermined amount to prohibit the inserts from being pulled from the bearing member, wherein the inserts and the frame are integrally formed by injection molding to define a first insert plate with the inserts projecting upwardly from the frame; and (f) a second insert plate abutting the first insert plate in a modular fashion to provide the bearing member with a longer effective insert plate and additional inserts.

* * * * *

UNITED STATES PATENT AND TRADEMARK OFFICE

CERTIFICATE OF CORRECTION

PATENT NO. : 5,863,050

DATED : January 26, 1999

INVENTOR(S) : A.L. Meader et al.

It is certified that error appears in the above-indentified patent and that said Letters Patent is hereby corrected as shown below:

On the title page,

| COLUMN | LINE | |
|---|---|---|
| [56] Pg. 1, col. 2 | Refs. Cited (Foreign Pats., item 6) | "620028A1" should read --EPO00620028A1-- |
| [56] Pg. 1, col. 2 | Refs. Cited (Foreign Pats., item 8) | "29 13 250" should read --DE 29 13 250-- |
| [57] Pg. 1, col. 2 | Abstract line 9 of text | "to the insert plate." should read --from the insert plate.-- |

Signed and Sealed this

Twenty-ninth Day of June, 1999

*Attest:*

*Attesting Officer*

Q. TODD DICKINSON

*Acting Commissioner of Patents and Trademarks*